US009741522B1

(12) United States Patent
Chaney et al.

(10) Patent No.: US 9,741,522 B1
(45) Date of Patent: Aug. 22, 2017

(54) CERAMIC ION SOURCE CHAMBER

(71) Applicant: Varian Semiconductor Equipment Associates, Inc., Gloucester, MA (US)

(72) Inventors: Craig R. Chaney, Gloucester, MA (US); Neil J. Bassom, Hamilton, MA (US)

(73) Assignee: Varian Semiconductor Equipment Associates, Inc., Gloucester, MA (US)

( * ) Notice: Subject to any disclaimer, the term of this patent is extended or adjusted under 35 U.S.C. 154(b) by 0 days.

(21) Appl. No.: 15/009,904

(22) Filed: Jan. 29, 2016

(51) Int. Cl.
*H01J 27/20* (2006.01)
*H01J 27/02* (2006.01)

(52) U.S. Cl.
CPC ..... *H01J 27/205* (2013.01); *H01J 27/022* (2013.01); *H01J 27/024* (2013.01)

(58) Field of Classification Search
CPC ..... H01J 27/205; H01J 27/022; H01J 27/024; H01J 27/02; H01J 37/04; H01J 37/06; H01J 49/10; H01J 3/024; H01J 17/50; H01J 17/64; H01J 2201/19; H01J 2201/28; H01J 2329/0402; H01J 1/15; H01J 1/20
See application file for complete search history.

(56) References Cited

U.S. PATENT DOCUMENTS 4,737,688 A * 4/1988 Collins ..... H01J 27/022 313/361.1
5,252,892 A * 10/1993 Koshiishi ..... H01J 27/20 250/423 R
6,583,427 B1 6/2003 Edmonds et al.
2002/0069824 A1* 6/2002 Dangelo ..... H01J 37/08 118/715
2008/0054194 A1 3/2008 Kim et al.
2010/0024841 A1 2/2010 Koo et al.
2011/0174606 A1 7/2011 Funk et al.
2014/0062286 A1 3/2014 Sato
2014/0353518 A1 12/2014 Sato

FOREIGN PATENT DOCUMENTS

JP 2014-235814 A 12/2014
KR 10-0757347 B1 9/2007

OTHER PUBLICATIONS

International Search Report and Written Opinion dated Mar. 29, 2017 in corresponding PCT application No. PCT/US2016/067553.

* cited by examiner

*Primary Examiner* — Joseph L Williams
*Assistant Examiner* — Jose M Diaz
(74) *Attorney, Agent, or Firm* — Nields, Lemack & Frame, LLC

(57) ABSTRACT

The IHC ion source comprises an ion source chamber having a cathode and a repeller on opposite ends. The ion source chamber is constructed of a ceramic material having very low electrical conductivity. An electrically conductive liner may be inserted into the ion source chamber and may cover three sides of the ion source chamber. The liner may be electrically connected to the faceplate, which contains the extraction aperture. The electrical connections for the cathode and repeller pass through apertures in the ceramic material. In this way, the apertures may be made smaller than otherwise possible as there is no risk of arcing. In certain embodiments, the electrical connections are molded into the ion source chamber or are press fit in the apertures. Further, the ceramic material used for the ion source chamber is more durable and introduces less contaminants to the extracted ion beam.

18 Claims, 6 Drawing Sheets

CERAMIC ION SOURCE CHAMBER

FIELD

Embodiments of the present disclosure relate to an indirectly heated cathode (IHC) ion source, and more particularly, an IHC ion source chamber made from a ceramic material.

BACKGROUND

Indirectly heated cathode (IHC) ion sources operate by supplying a current to a filament disposed behind a cathode. The filament emits thermionic electrons, which are accelerated toward and heat the cathode, in turn causing the cathode to emit electrons into the ion source chamber. The cathode is disposed at one end of the ion source chamber. A repeller is typically disposed on the end of the ion source chamber opposite the cathode. The repeller may be biased so as to repel the electrons, directing them back toward the center of the ion source chamber. In some embodiments, a magnetic field is used to further confine the electrons within the ion source chamber. The electrons cause a plasma to be created. Ions are then extracted from the ion source chamber through an extraction aperture.

The ion source chamber is typically made of an electrically conductive material, which has good electrical conductivity and a high melting point. The ion source chamber may be maintained at a certain electrical potential. Additionally, the cathode and the repeller are disposed within the ion source chamber, and are typically maintained at electrical potentials that are different from the ion source chamber. Further, apertures are created in the walls of the ion source chamber to allow electrical connections to the cathode and the repeller. These apertures are sized such that arcing does not occur between the wall of the ion source chamber and the electrical connections to the cathode and repeller. These apertures, however, also allow feed gas, which is introduced into the ion source chamber, to escape.

Additionally, the materials used to make the ion source chamber may also have good thermal conductivity as one function of the ion source chamber may be to remove heat from within the chamber via conduction to a cooler surface.

Thus, the materials used for the ion source chamber typically have high melting points, good electrical conductivity and good thermal conductivity. In some embodiments, materials such as tungsten and molybdenum are used to construct the ion source chamber.

One issue associated with IHC ion sources is that the material used to construct the ion source chamber may be expensive and difficult to machine. Additionally, the ions generated within the ion source chamber may cause particles of the ion source chamber to be removed and introduced into the extracted ion beam. Thus, the material used to create the ion source chamber may introduce contamination into the extracted ion beam. Further, feed gas is lost through the apertures that are created to allow electrical connections to the cathode and repeller.

Therefore, an IHC ion source in which the material used to construct the ion source chamber did not contaminate the ion beam would be advantageous. Further, it would be beneficial if the openings used to provide electrical connection to the cathode and repeller could be reduced in size or eliminated, so as to reduce the flow of feed gas escaping from the ion source chamber.

SUMMARY

The IHC ion source comprises an ion source chamber having a cathode and a repeller on opposite ends. The ion source chamber is constructed of a ceramic material having very low electrical conductivity. An electrically conductive liner may be inserted into the ion source chamber and may cover at least three sides of the ion source chamber. The liner may be electrically connected to the faceplate, which contains the extraction aperture. The electrical connections for the cathode and repeller pass through apertures in the ceramic material. In this way, the apertures may be made smaller than otherwise possible as there is no risk of shorting or arcing. In certain embodiments, electrically conductive pieces are molded into the ion source chamber or are press fit in the apertures. Further, the ceramic material used for the ion source chamber is more durable and introduces less contaminants to the extracted ion beam.

According to one embodiment, an indirectly heated cathode ion source is disclosed. The indirectly heated cathode comprises an ion source chamber into which a gas is introduced, the ion source chamber constructed of an electrically insulating material and having a bottom, two opposite ends, and two sides; a cathode disposed on one of the two opposite ends of the ion source chamber; a repeller disposed at a second of the two opposite ends of the ion source chamber; an electrically conductive liner covering at least one of the bottom and the two sides of the ion source chamber; and a faceplate having an extraction aperture disposed opposite the bottom of the ion source chamber. In certain embodiments, the faceplate is electrically conductive, and the electrically conductive liner is in electrical contact with the faceplate. In certain embodiments, the electrically conductive liner is in electrical contact with the cathode. In certain embodiments, the electrically conductive liner is in electrical contact with the repeller. In certain embodiments, the indirectly heated cathode ion source comprises a liner power supply, wherein the electrically conductive liner is in electrical contact with the liner power supply. In certain embodiment, the electrically insulating material comprises a ceramic material. In certain embodiments, the ceramic material comprises aluminum nitride. In other embodiments, the ceramic material is selected from the group consisting of silicon carbide, zirconium, yttrified-zirconium carbide, and zirconium oxide. Further, in certain embodiments, the electrically conductive liner comprises three planar segments. In certain embodiments, the electrically conductive liner has a "U" shape.

According to another embodiment, an indirectly heated cathode ion source is disclosed. The indirectly heated cathode ion source comprises an ion source chamber into which a gas is introduced, the ion source chamber constructed of a ceramic material and having a bottom, two opposite ends, and two sides; a cathode disposed on one of the two opposite ends of the ion source chamber; a repeller disposed at a second of the two opposite ends of the ion source chamber; an electrically conductive liner covering the bottom and two sides of the ion source chamber; and an electrically conductive faceplate having an extraction aperture disposed opposite the bottom of the ion source chamber and in electrical communication with the electrically conductive liner.

In another embodiment, an apparatus for use with an indirectly heated cathode ion source is disclosed. The apparatus comprises an ion source chamber constructed of an electrically insulating material and having a bottom, two opposite ends, and two sides; an electrically conductive liner covering at least one of the bottom and the two sides of the ion source chamber; and a faceplate having an extraction aperture disposed opposite the bottom of the ion source chamber. In certain embodiments, the electrically conductive liner covers the bottom and the two sides of the ion source chamber.

BRIEF DESCRIPTION OF THE FIGURES

For a better understanding of the present disclosure, reference is made to the accompanying drawings, which are incorporated herein by reference and in which.

DETAILED DESCRIPTION

As described above, indirectly heated cathode ion sources may be susceptible to contamination due to the material used to construct the ion source chamber. Further, apertures in the ion source chamber, which are used to supply electrical connections to the cathode and repeller, allow feed gas to escape.

Figure 1:
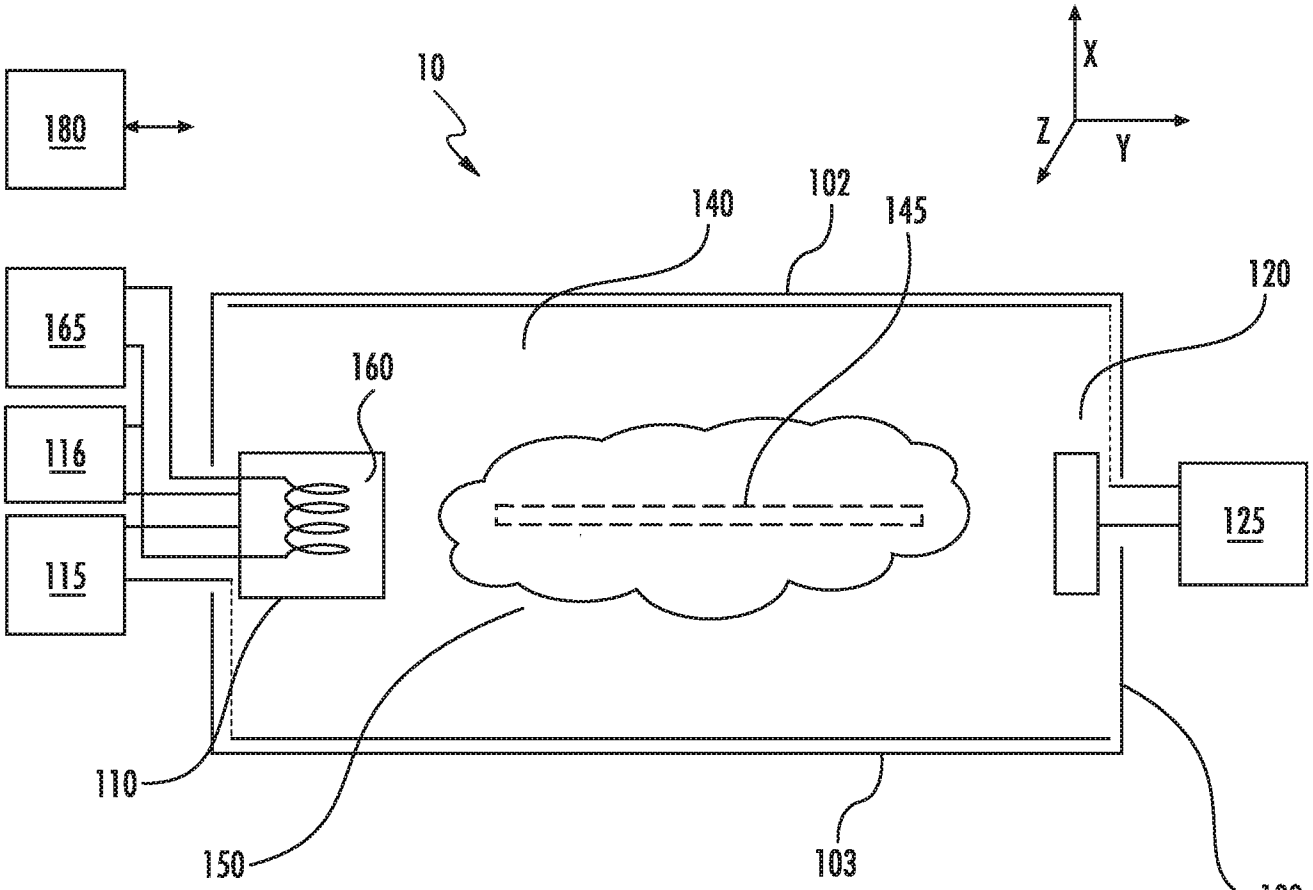
FIG. 1 is an ion source in accordance with one embodiment.

FIG. 1 shows a first embodiment of an IHC ion source 10 that overcomes these issues. The IHC ion source 10 includes an ion source chamber 100, having two opposite ends, and sides 102, 103 connecting to these ends. The ion source chamber 100 may be constructed of an electrically insulating material, such as a ceramic material. An electrically conductive liner 130 is disposed within the ion source chamber 100 may cover at least two surfaces of the ion source chamber 100. For example, the electrically conductive liner 130 may cover the sides 102, 103 that connect the opposite ends of the ion source chamber 100. The electrically conductive liner 130 may also cover the bottom 101 of the ion source chamber 100. A cathode 110 is disposed inside the ion source chamber 100 at one of the two opposite ends of the ion source chamber 100. This cathode 110 is in communication with a cathode power supply 115, which serves to bias the cathode 110 with respect to the electrically conductive liner 130. In certain embodiments, the cathode power supply 115 may negatively bias the cathode 110 relative to the electrically conductive liner 130. For example, the cathode power supply 115 may have an output in the range of 0 to−150V, although other voltages may be used. In certain embodiments, the cathode 110 is biased at between 0 and -40V relative to the electrically conductive liner 130 of the ion source chamber 100. A filament 160 is disposed behind the cathode 110. The filament 160 is in communication with a filament power supply 165. The filament power supply 165 is configured to pass a current through the filament 160, such that the filament 160 emits thermionic electrons. Cathode bias power supply 116 biases filament 160 negatively relative to the cathode 110, so these thermionic electrons are accelerated from the filament 160 toward the cathode 110 and heat the cathode 110 when they strike the back surface of cathode 110. The cathode bias power supply 116 may bias the filament 160 so that it has a voltage that is between, for example, 300V to 600V more negative than the voltage of the cathode 110. The cathode 110 then emits thermionic electrons on its front surface into ion source chamber 100.

Thus, the filament power supply 165 supplies a current to the filament 160. The cathode bias power supply 116 biases the filament 160 so that it is more negative than the cathode 110, so that electrons are attracted toward the cathode 110 from the filament 160. Finally, the cathode power supply 115 biases the cathode 110 more negatively than the electrically conductive liner 130 disposed within the ion source chamber 100.

A repeller 120 is disposed inside the ion source chamber 100 on the end of the ion source chamber 100 opposite the cathode 110. The repeller 120 may be in communication with repeller power supply 125. As the name suggests, the repeller 120 serves to repel the electrons emitted from the cathode 110 back toward the center of the ion source chamber 100. For example, the repeller 120 may be biased at a negative voltage relative to the electrically conductive liner 130 disposed within the ion source chamber 100 to repel the electrons. Like the cathode power supply 115, the repeller power supply 125 may negatively bias the repeller 120 relative to the electrically conductive liner 130 in the ion source chamber 100. For example, the repeller power supply 125 may have an output in the range of to −150V, although other voltages may be used. In certain embodiments, the repeller 120 is biased at between 0 and −40V relative to the electrically conductive liner 130 disposed within the ion source chamber 100.

In certain embodiments, the cathode 110 and the repeller 120 may be connected to a common power supply. Thus, in this embodiment, the cathode power supply 115 and repeller power supply 125 are the same power supply.

Although not shown, in certain embodiments, a magnetic field is generated in the ion source chamber 100. This magnetic field is intended to confine the electrons along one direction. For example, electrons may be confined in a column that is parallel to the direction from the cathode 110 to the repeller 120 (i.e. the y direction).

Disposed on the top of the ion source chamber 100 may be a faceplate 140 including an extraction aperture 145. In FIG. 1, the extraction aperture 145 is disposed on the faceplate 140 that is parallel to the X-Y plane (parallel to the page). The faceplate 140 may be an electrically conductive material, such as tungsten. Further, while not shown, the IHC ion source 10 also comprises a gas inlet through which the gas to be ionized is introduced into the ion source chamber 100.

A controller 180 may be in communication with one or more of the power supplies such that the voltage or current supplied by these power supplies may be modified. The controller 180 may include a processing unit, such as a microcontroller, a personal computer, a special purpose controller, or another suitable processing unit. The controller 180 may also include a non-transitory storage element, such as a semiconductor memory, a magnetic memory, or another suitable memory. This non-transitory storage element may contain instructions and other data that allows the controller 180 to maintain appropriate voltages for the filament 160, the cathode 110 and the repeller 120.

During operation, the filament power supply 165 passes a current through the filament 160, which causes the filament 160 to emit thermionic electrons. These electrons strike the back surface of the cathode 110, which may be more positive than the filament 160, causing the cathode 110 to heat, which in turn causes the cathode 110 to emit electrons into the ion source chamber 100. These electrons collide with the molecules of gas that are fed into the ion source chamber 100 through the gas inlet. These collisions create ions, which form a plasma 150. The plasma 150 may be confined and manipulated by the electrical fields created by the cathode 110, and the repeller 120. In certain embodiments, the plasma 150 is confined near the center of the ion source chamber 100, proximate the extraction aperture 145. The ions are then extracted through the extraction aperture as an ion beam.

Figure 2B:
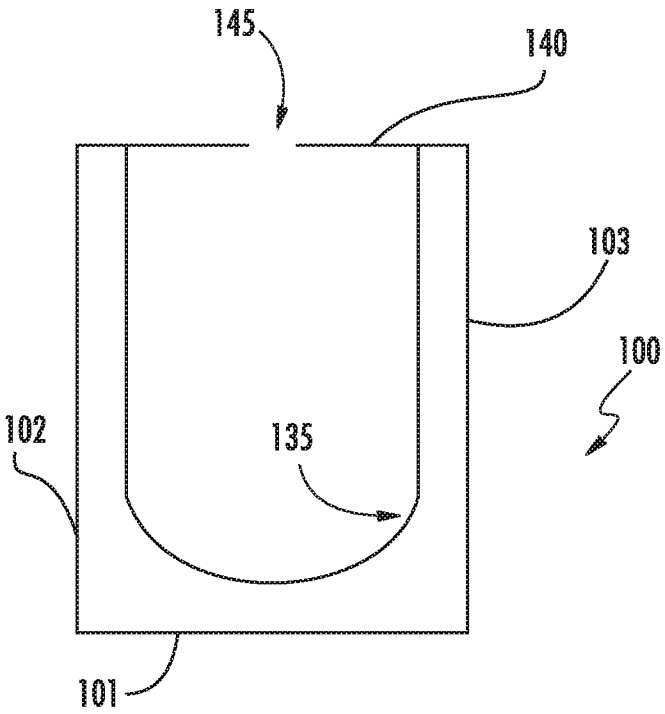
FIG. 2B is an end view of the ion source of FIG. 1 having a liner according to a second embodiment.
Figure 2A:
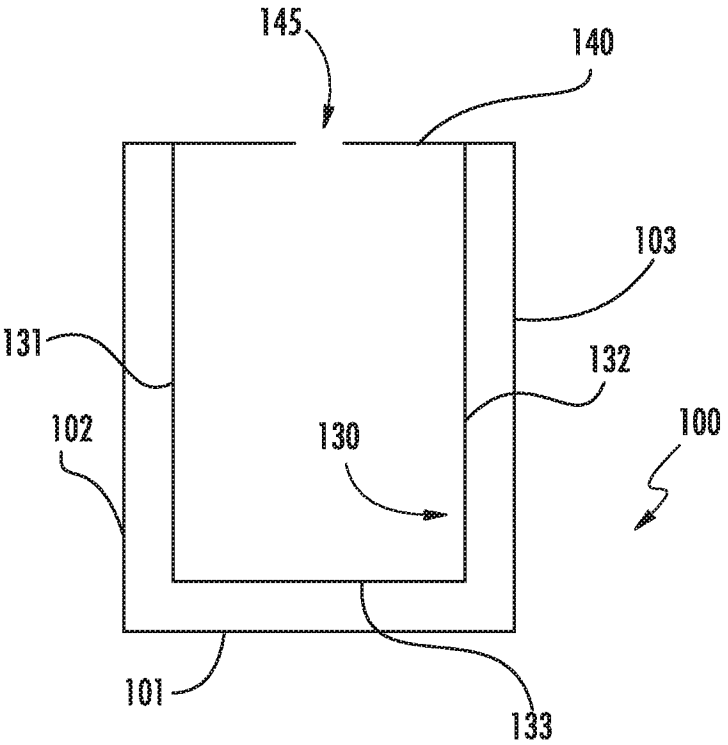
FIG. 2A is an end view of the ion source of FIG. 1 having a liner according to a first embodiment.

FIG. 2A shows an end view showing a first embodiment of an electrically conductive liner 130. In this embodiment, the electrically conductive liner 130 covers two sides 102, 103 of the ion source chamber 100, and also covers the bottom 101. The bottom 101 is the surface opposite the faceplate 140. In this embodiment, the electrically conductive liner 130 is formed using three planar segments 131, 132, 133. These segments may form a unitary piece or may be separate pieces. Planar segments 131, 132, which cover the two sides 102, 103, are in contact with the faceplate 140 and are also in contact with planar segment 133, which covers the bottom 101. Thus, all segments are at the same electrical potential as the faceplate 140. In the embodiment where the segments are individual pieces, electrical connection between the planar segments may be insured through the use of interference fits, springs, or other mechanisms. The connection between the faceplate 140 and the planar segments 131, 132 may be achieved in the same manner. The faceplate 140 may be an electrically conductive material, such as tungsten. Thus, by electrically biasing the faceplate 140, the electrically conductive liner 130 may also be biased at the same electrical potential.

Thus, while FIG. 1 shows the cathode power supply 115 and the repeller power supply 125 in contact with the electrically conductive liner 130, in some embodiments, these power supplies are actually in electrical contact with the faceplate 140.

FIG. 2B shows a second embodiment of an electrically conductive liner 135. In this embodiment, the electrically conductive liner 135 may be "U" shaped, such that the liner covers the sides 102, 103 and the bottom 101 of the ion source chamber 100. As seen in the figure, the rounded portion of the electrically conductive liner 135 is proximate the bottom 101 of the ion source chamber 100. As described above, the electrically conductive liner 135 may be in electrical contact with the faceplate 140, and thus is maintained at the same electrical potential as the faceplate 140.

The electrically conductive liners illustrated in FIGS. 2A-2B may cover two sides 102, 103 and the bottom 101, but not the two ends of the ion source chamber 100. Since the cathode 110 is disposed on one end and the repeller 120 is disposed on the other end of the ion source chamber 100, the small area of exposed ceramic material will not have a deleterious effect on the plasma 150. Further, in certain embodiments, the electrically conductive liner may cover less than these three surfaces. For example, the electrically conductive liner may cover at least one of the bottom 101 and the two sides 102, 103.

While the above disclosure describes a configuration where the electrically conductive liner 130 is in electrical communication with the faceplate 140, other embodiments are also possible.

Figure 3:
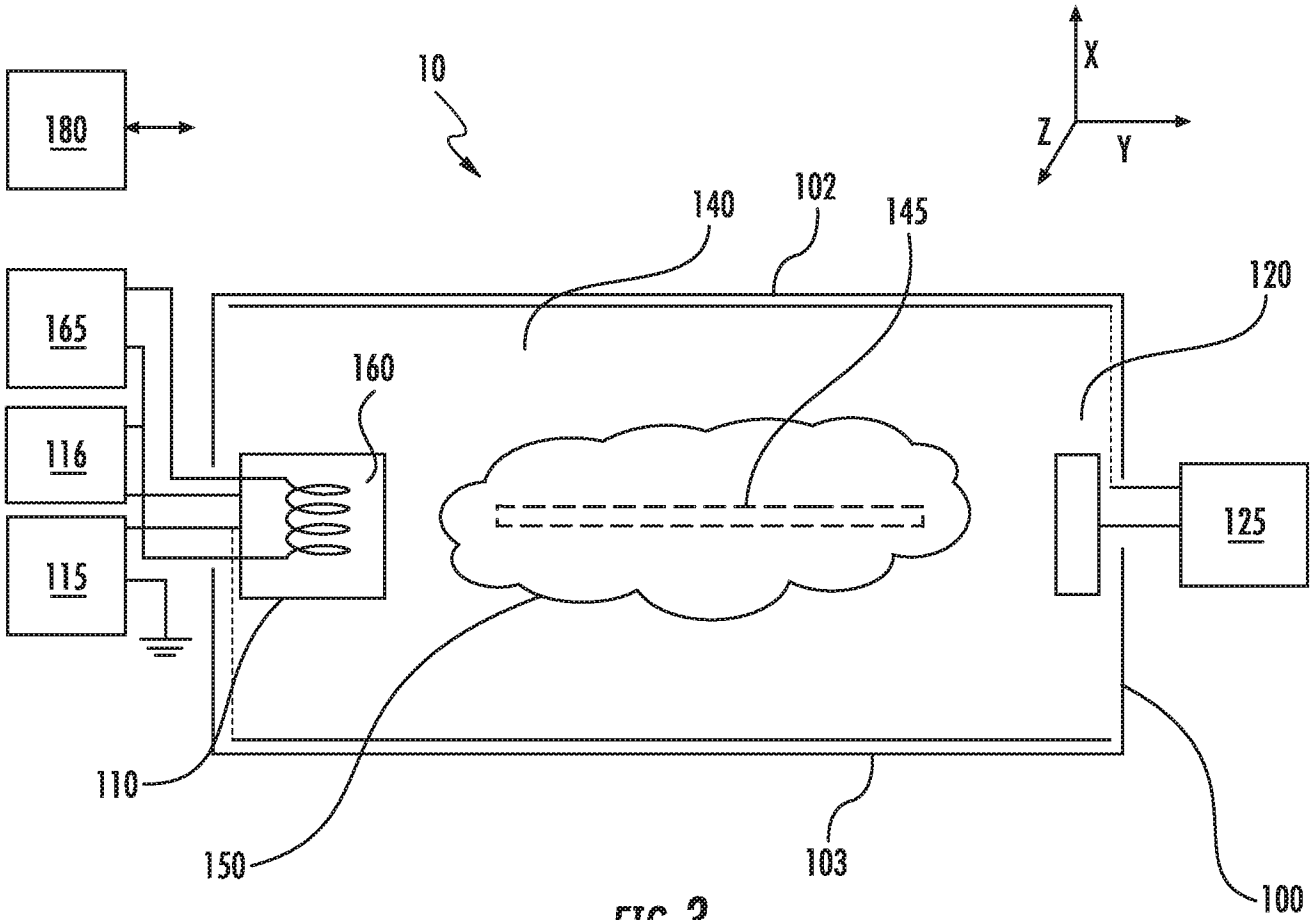
FIG. 3 is an ion source in accordance with another embodiment.

For example, in one embodiment, one or more segments of the electrically conductive liner 130 are electrically connected to the cathode 110. In other words, rather than connecting the electrically conductive liner 130 to the faceplate 140, the electrically conductive liner 130 is connected to the cathode 110. The connection between the electrically conductive liner 130 and the cathode 110 may be made in a number of ways, including interference fits, springs, or other mechanisms. In certain embodiments, an insulating material may be disposed along the top of the ion source chamber 100 to insure that the electrically conductive liner 130 does not contact the faceplate 140. In another embodiment, the electrically conductive liner 135 having a "U" shape is used and electrically connected to the cathode 110. FIG. 3 shows an embodiment where the cathode power supply 115 is referenced to ground, and is used to provide an electrical potential to the cathode 110 and the electrically conductive liner 130. The repeller power supply 125 may still be referenced to the electrically conductive liner 130, or may be referenced to another voltage.

Figure 4:
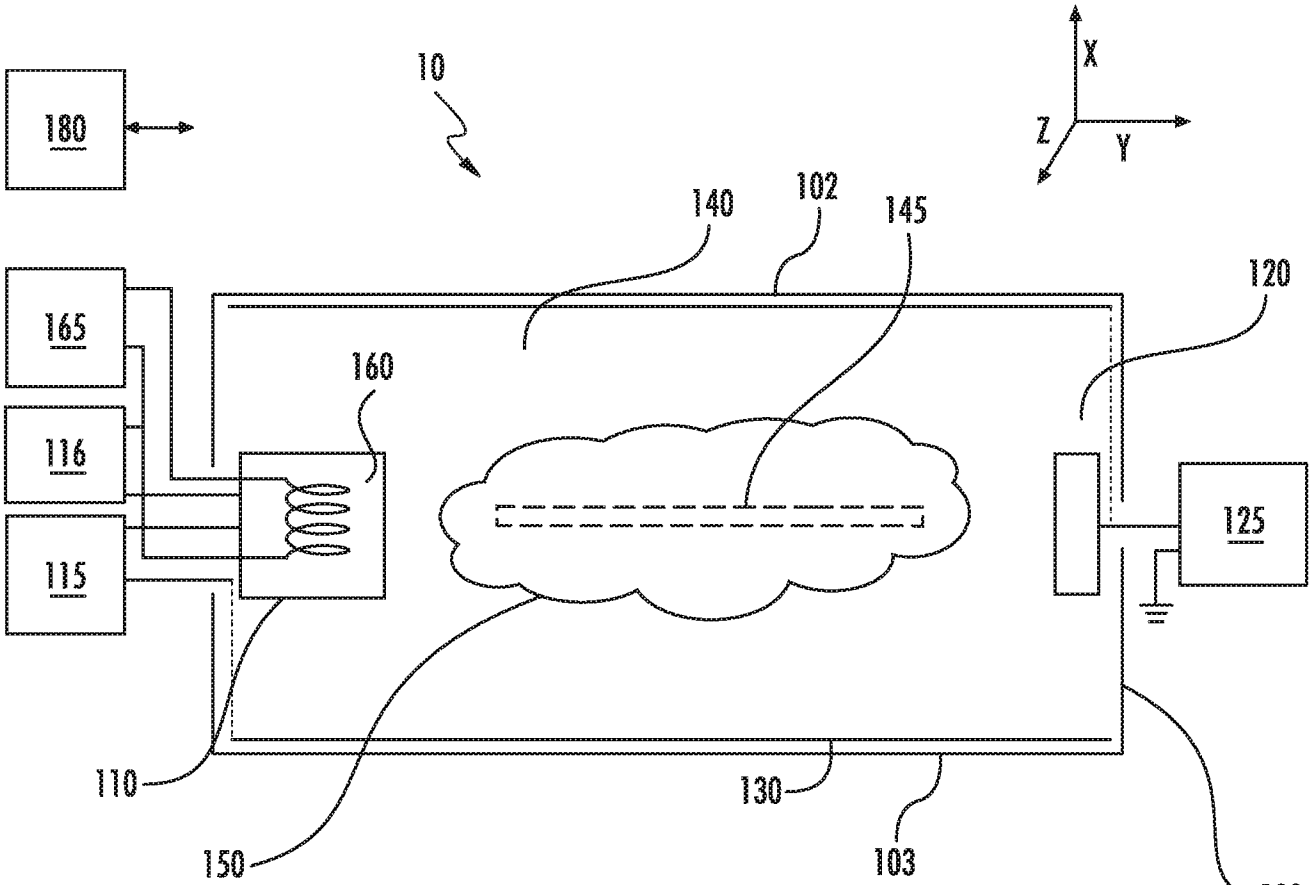
FIG. 4 is an ion source in accordance with a third embodiment.

In another embodiment, one or more segments of the electrically conductive liner 130 are electrically connected to the repeller 120. Again, in certain embodiments, an insulating material may be disposed along the top of the ion source chamber 100 to insure that the electrically conductive liner 130 does not contact the faceplate 140. In another embodiment, the electrically conductive liner 135 having a "U" shape is used and electrically connected to the repeller 120. FIG. 4 shows an embodiment where the repeller power supply 125 is referenced to ground, and is used to provide an electrical potential to the repeller 120 and the electrically conductive liner 130. The cathode power supply 115 may still be referenced to the electrically conductive liner 130, or may be referenced to another voltage.

In yet other embodiments, the planar segments of the electrically conductive liner 130 may be connected to different voltages. For example, one or more segments may be connected to the faceplate 140, the cathode 110 or the repeller 120. Another of the segments may be connected to another of the faceplate 140, the cathode 110 or the repeller 120.

Figure 5:
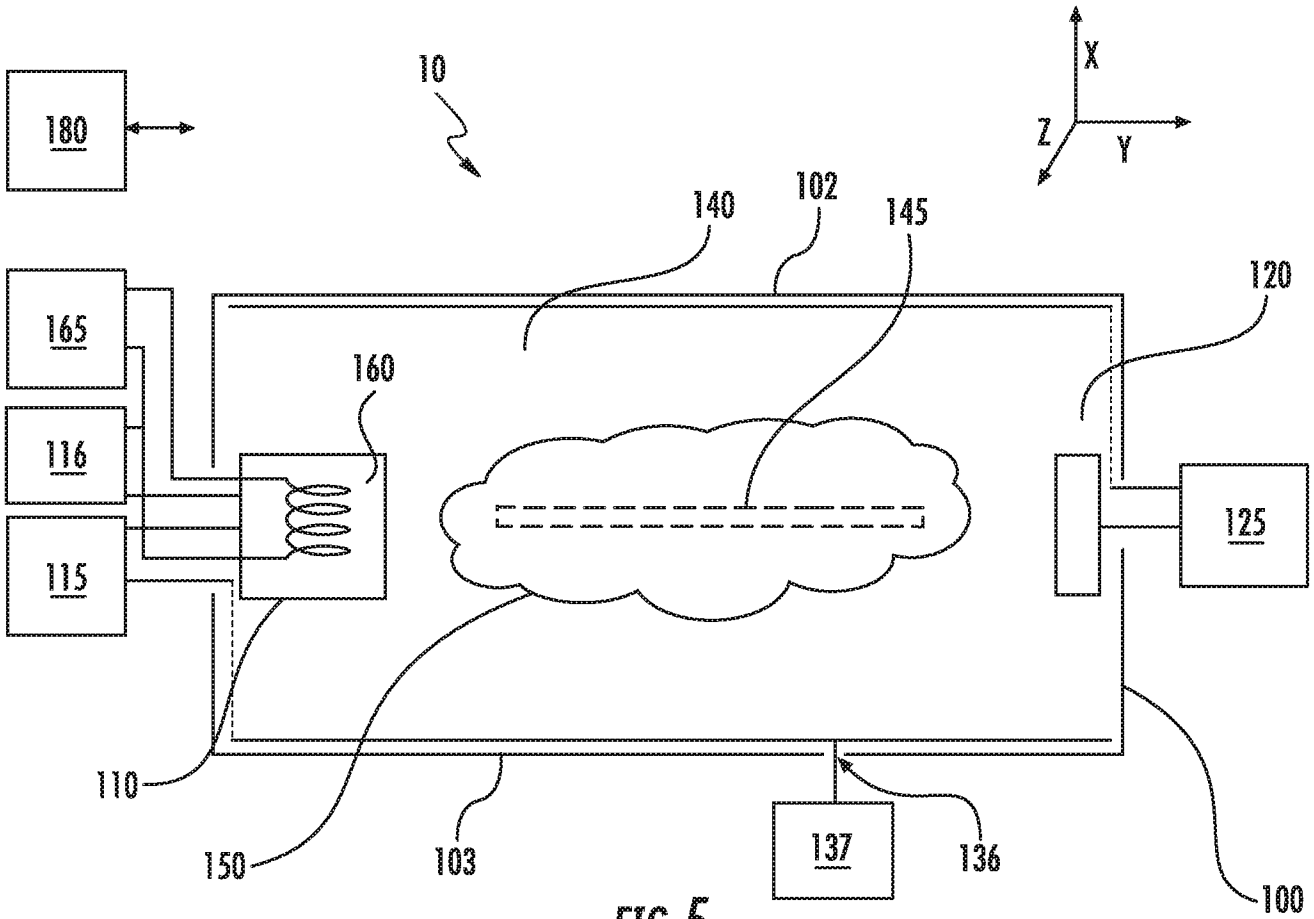
FIG. 5 is an ion source in accordance with a fourth embodiment.

Additionally, in certain embodiments, the electrically conductive liner 130 may be connector to a voltage that is different than the faceplate 140, the cathode 110 or the repeller 120. For example, there may be a liner power supply 137, which is in communication with the electrically conductive liner 130, such as through an aperture 136 in the ion source chamber 100, as shown in FIG. 5.

As described above, the ion source chamber 100 may be constructed from an electrically insulating material, such as a ceramic material. In some embodiments, the ceramic material may be selected such that it has a melting point of at least 2000° C. to withstand the extreme temperatures experienced within the ion source chamber 100.

Additionally, ceramic materials typically have high hardness values, such as 7 or more on the Mhos scale. This hardness allows the ceramic material to withstand repeated aggressive cleanings. Further, this may reduce the amount of contaminants introduced by the ion source chamber 100.

Further, in certain embodiments, the ceramic material is selected such that it has a thermal conductivity similar to that of traditional materials used to construct the ion source chamber 100, such as tungsten or molybdenum. These metals have a thermal conductivity of between 135 and 175 W/mK. This may allow the ion source chamber to quickly remove heat via convection to a cooled surface.

In one embodiment, the ceramic material may be aluminum nitride (AlN), which has a thermal conductivity of 140-180 W/mK. Of course, other ceramic materials, such as alumina ($Al_2O_3$), silicon carbide, zirconium, yttrified-zirconium carbide, and zirconium oxide may also be used.

The ceramic material used for the ion source chamber 100 has much higher electrical resistivity than the metals that are traditionally used, such as 1e14 Ω-cm or more. Thus, the apertures in the ion source chamber 100 used to accommodate the electrical connections for the cathode 110 and the repeller 120 may be made much smaller than would be otherwise possible. This is because there is no risk of arcing or shorting between the ion source chamber 100 and the electrical connection.

In one embodiment, the aperture in the ion source chamber 100 is dimensioned such that its diameter is substantially equal to the diameter of the electrical connection or electrically conductive material passing through the aperture. For example, as shown in FIG. 6A, the repeller 120 may have a stem 122 that passes through an aperture 105 in the ion source chamber 100. The stem 122 may have a first diameter, while the aperture 105 may have a second diameter which is substantially equal to the first diameter. For example, in some embodiments, the interface between the stem 122 and the aperture 105 may be a press fit or an interference fit.

Figure 6B:
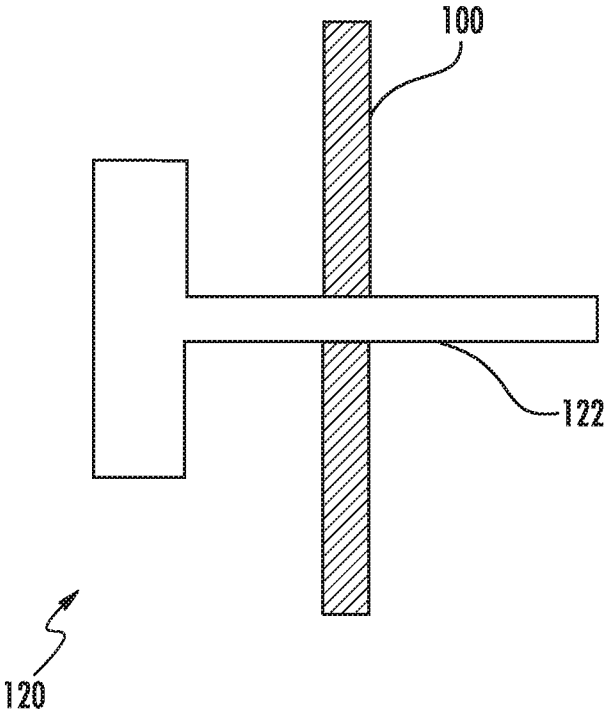
FIG. 6B shows a cross-section view of the repeller and its electrical connection according to a second embodiment.
Figure 6A:
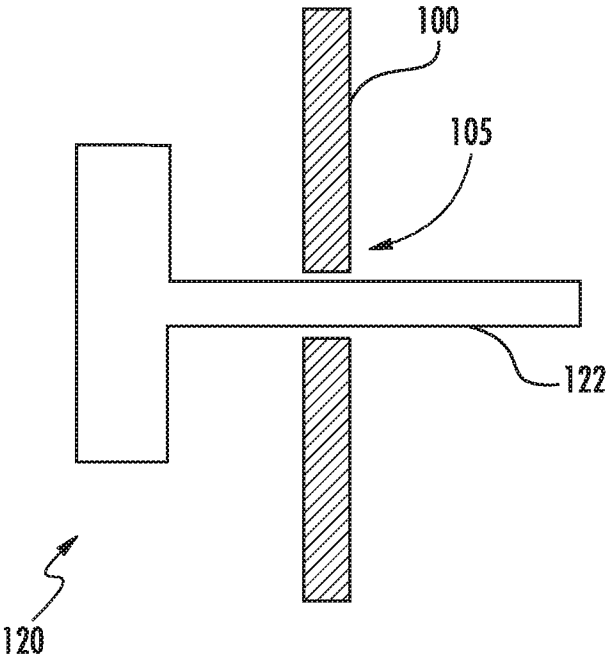
FIG. 6A shows a cross-section view of the repeller and its electrical connection according to one embodiment.

FIG. 6B shows another embodiment. In this embodiment, the stem 122 is molded or otherwise formed as part of the ion source chamber 100, such that there is no aperture at all. In this embodiment, feed gas cannot escape from the ion source chamber 100, as there is no opening in the ion source chamber 100.

While FIGS. 6A-6B show the repeller 120, the electrical connections for the cathode 110 and the filament 160 may be accommodated in the same manner. Thus, by using an electrically insulating material to construct the ion source chamber 100, the apertures used for electrical connections may be reduced in size or removed, reducing or possibly eliminating the flow of feed gas escaping from the ion source chamber 100. For example, an electrically conductive material may be molded into the ion source chamber 100. Connections may be made to the electrically conductive material on both sides of the ion source chamber 100 to complete the electrical circuit.

Thus, in certain embodiments, the IHC ion source 10 includes an ion source chamber 100, constructed from an electrically insulating material. The ion source chamber 100 has a bottom 101, two sides 102, 103, and opposite ends. The cathode 110 and the repeller 120 are disposed on respective ends of the ion source chamber 100. An electrically conductive liner is used to cover at least one of the sides 102, 103 and the bottom 101 of the ion source chamber. The liner may optionally also cover at least a portion of the ends of the ion source chamber 100. In certain embodiments, a faceplate 140, which is electrically conductive, is disposed on the top of the ion source chamber 100, and is in electrical contact with the electrically conductive liner. Thus, in this way, electrical potentials may be established along the sides and bottom of the ion source chamber 100, even though the ion source chamber 100 itself is not conductive. Further, apertures in the ion source chamber 100, which allow the passage of electrical connections or electrically conductive materials to the cathode 110 and the repeller 120, may be made smaller or eliminated since there is no risk of shorting or arcing.

In other embodiments, the electrically conductive liner may be electrically connected to a different voltage. For example, there may be a separate liner power supply that provides the electrical potential to the electrically conductive liner. In other embodiments, one or more portions of the electrically conductive liner may be electrically connected to the repeller 120 or the cathode 110.

Thus, the IHC ion source includes an ion source chamber made of an electrically insulating material having a bottom, two sides and two opposite ends. An electrically conductive liner is disposed so as to cover at least one of the bottom and the two sides. A faceplate having an extraction aperture is disposed opposite the bottom of the ion source chamber. The electrically conductive liner is connected to a power supply.

The embodiments described above in the present application may have many advantages. First, the use of ceramic materials for the ion source chamber may reduce the introduction of contaminants into the extracted ion beam, as compared to metal ion source chambers. Further, these ceramic materials may be less expensive than the metal currently used for the ion source chamber. Additionally, these ceramic materials may be able to withstand more aggressive cleanings than traditional materials. Lastly, the use of an electrically insulating ion source chamber allows an elimination or a reduction in the size of the apertures through which the electrical connections to the cathode and repeller pass. This may reduce the amount of feed gas that escapes through these apertures.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

What is claimed is:

1. An indirectly heated cathode ion source, comprising:

an ion source chamber into which a gas is introduced, the ion source chamber constructed of an electrically insulating material and having a bottom, two opposite ends, and two sides;

a cathode disposed on one of the two opposite ends of the ion source chamber;

a repeller disposed at a second of the two opposite ends of the ion source chamber;

an electrically conductive liner covering the bottom and the two sides of the ion source chamber; and a faceplate having an extraction aperture disposed opposite the bottom of the ion source chamber.

2. The indirectly heated cathode ion source of claim 1, wherein the faceplate is electrically conductive, and the electrically conductive liner is in electrical contact with the faceplate.

3. The indirectly heated cathode ion source of claim 1, wherein the electrically conductive liner is in electrical contact with the cathode.

4. The indirectly heated cathode ion source of claim 1, wherein the electrically conductive liner is in electrical contact with the repeller.

5. The indirectly heated cathode ion source of claim 1, further comprising a liner power supply, wherein the electrically conductive liner is in electrical contact with the liner power supply.

6. The indirectly heated cathode ion source of claim 1, further comprising a first electrical connection passing through a first aperture in the ion source chamber to the cathode, and a second electrical connection passing through a second aperture in the ion source chamber to the repeller, wherein the first aperture and the second aperture are dimensioned such that the first electrical connection and the second electrical connection contacts the ion source chamber.

7. The indirectly heated cathode ion source of claim 1, further comprising a first electrical connection passing through the ion source chamber to the cathode, and a second electrical connection passing through the ion source chamber to the repeller, wherein a first electrically conductive material and a second electrically conductive material are molded into the ion source chamber, wherein the first electrically conductive material and the second electrically conductive material form part of the first electrical connection and the second electrical connection, respectively.

8. The indirectly heated cathode ion source of claim 1, wherein the electrically insulating material comprises a ceramic material.

9. The indirectly heated cathode ion source of claim 8, wherein the ceramic material comprises aluminum nitride.

10. The indirectly heated cathode ion source of claim 8, wherein the ceramic material is selected from the group consisting of silicon carbide, zirconium, yttrified-zirconium carbide, and zirconium oxide.

11. The indirectly heated cathode ion source of claim 1, wherein the electrically conductive liner comprises three planar segments.

12. The indirectly heated cathode ion source of claim 1, wherein the electrically conductive liner has a "U" shape.

13. An indirectly heated cathode ion source, comprising:

an ion source chamber into which a gas is introduced, the ion source chamber constructed of a ceramic material and having a bottom, two opposite ends, and two sides;

a cathode disposed on one of the two opposite ends of the ion source chamber;

a repeller disposed at a second of the two opposite ends of the ion source chamber;

an electrically conductive liner covering the bottom and two sides of the ion source chamber; and an electrically conductive faceplate having an extraction aperture disposed opposite the bottom of the ion source chamber and in electrical communication with the electrically conductive liner.

14. The indirectly heated cathode ion source of claim 13, wherein the electrically conductive liner comprises three planar segments.

15. The indirectly heated cathode ion source of claim 13, wherein the electrically conductive liner has a "U" shape.

16. The indirectly heated cathode ion source of claim 13, wherein the ceramic material comprises aluminum nitride.

17. The indirectly heated cathode ion source of claim 13, wherein the ceramic material is selected from the group consisting of silicon carbide, zirconium, yttrified-zirconium carbide, and zirconium oxide.

18. An apparatus for use with an indirectly heated cathode ion source, comprising:

an ion source chamber constructed of an electrically insulating material and having a bottom, two opposite ends, and two sides;

an electrically conductive liner covering the bottom and the two sides of the ion source chamber; and a faceplate having an extraction aperture disposed opposite the bottom of the ion source chamber.

* * * * *